United States Patent [19]

Kanai et al.

[11] Patent Number: 4,772,800

[45] Date of Patent: Sep. 20, 1988

[54] METHOD OF DETECTING A BROKEN YARN IN A ROW OF LINE UP YARNS AND APPARATUS THEREFOR

[75] Inventors: Kenzo Kanai; Keisuke Hookabe; Kenji Yamada, all of Fukui, Japan

[73] Assignee: Kanai School Incorporated, Fukui, Japan

[21] Appl. No.: 843,610

[22] Filed: Mar. 25, 1986

[30] Foreign Application Priority Data

Mar. 25, 1985 [JP] Japan ..... 60-60429

[51] Int. Cl.[4] ..... G01V 9/04

[52] U.S. Cl. ..... 250/561; 377/53

[58] Field of Search ..... 250/561, 562, 563, 572; 356/237, 235, 430, 431; 19/0.21, 0.25; 28/187; 57/81; 66/161; 139/273 A; 242/3 R; 377/53

[56] References Cited

U.S. PATENT DOCUMENTS 3,345,812 10/1967 Pickering ..... 250/561
3,595,004 7/1971 Saunders ..... 250/561
3,595,005 7/1971 Saunders ..... 250/561
3,612,702 10/1971 Troll ..... 356/238
3,676,009 7/1972 Brendemuehl ..... 250/561
4,522,497 6/1985 Ikin ..... 356/431

*Primary Examiner*—David C. Nelms
*Assistant Examiner*—Jessica Ruoff
*Attorney, Agent, or Firm*—Staas & Halsey

[57] ABSTRACT

A method and apparatus for detecting a broken line up yarn, wherein a fine beam is adapted to travel widthwise across a row of line up yarns while it is radiated toward the yarns to cause flickerings which are photoelectrically converted to instantly count the current value for the number of yarns. The current value is compared with a standard threshold value, and if the current value is different from the threshold, an alarm signal is emitted indicating an abnormal condition. The present invention can be used as a broken yarn detecting technique for devices dealing with many line up yarns such as a warp knitting machine, a loom, a warping machine and so on.

17 Claims, 7 Drawing Sheets

METHOD OF DETECTING A BROKEN YARN IN A ROW OF LINE UP YARNS AND APPARATUS THEREFOR

BACKGROUND OF THE INVENTION

Devices such as a warp knitting machine, a loom and a warping machine operate on many rows of line up yarns for knitting, weaving, winding, sizing, etc., while the yarns are being supplied. When even one of the yarns in a row of line up yarns breaks, the devices must immediately detect it and stop the operation; otherwise defective articles are produced.

The warp knitting machine and the loom usually have a dropper type detection feeler; each of the warps is provided with a dropper and when a warp breaks, the dropper falls due to its own weight. The falling of the dropper causes the machine to stop either mechanically or electrically.

Warp knitting machines and looming machines run at remarkably high speeds. The above dropper type detection feeler is too time-wasting and inefficient because it needs a preparatory process of inserting warps through each dropper, and furthermore this feeler easily malfunctions owing to improper dropper fall or bad electrical contact, thereby failing to fully work as a monitoring/controlling means for these recent, high-speed machines.

Under these circumstances, a photoelectric feeler has come into use because it is more responsive and capable of monitoring the status of a warp and controlling a machine without contacting a warp. One photoelectric feeler in a broken yarn detection system includes a light emitter and a light receiver disposed at opposite ends of a row of warps so that the axis of emitted light coincides with that of the light receiver, and an alarm is sent out when a broken warp crosses the emitted light to interrupt the received light. This type of photoelectric feeler is likely to malfunction under the influence of ravellings and other floating things, and consequently fails to be a reliable monitoring means for line up yarns consisting of many warps.

SUMMARY OF THE INVENTION

Accordingly, an object of the present invention is to overcome the above problems of broken yarn detection techniques for warp knitting machines, looms and warping machines.

Another object of the present invention is to provide a new method and a new feeler used in this method which can immediately detect a broken yarn and emit an alarm signal without malfunctioning due to the influence of ravellings and other floating things.

Another object of the present invention is to provide a broken yarn detecting method and a feeler used in this method which does not monitor for broken unstable yarns, but directly monitors for the stable, normal position of yarns in a row of line up yarns.

Still another object of the present invention is to provide a high-productivity detection method and a feeler used therein which does not require time-wasting preparatory process of providing a dropper for each yarn in a row of line up yarns.

A further object of the present invention is to provide a broken yarn detection method and a feeler therefor which can restart a machine immediately after a broken yarn is fixed.

BRIEF DESCRIPTION OF THE DRAWINGS

The attached drawings illustrate embodiments and applications of the present invention.

FIG. 3(*b*) is a waveform of a photoelectric conversion means;

FIG. 5(*b*) is a perspective schematic view of another embodiment of a portion of the FIG. 5(*a*) apparatus;

DETAILED DESCRIPTION OF THE PREFERRED EMBODIMENTS

In contrast with other photoelectric broken yarn detection feelers, the present invention quantatively monitors normal line up yarns and adopts a system wherein a current total value for the number of yarns is compared with a threshold value for a number of yarns, and if there is a difference therebetween, an alarm signal is emitted. Other photoelectric feelers frequently malfunction because they detect a broken yarn which is unstable in posture and position and which is difficult to distinguish from ravelling and other floating things. On the other hand, the present invention monitors and counts the number of normally positioned yarns which are stable in posture and position and distinguishable from ravelings and so on. In this very point, the present invention has a very unique concept.

The following is a basic description of the present invention with reference to the attached drawings.

Figure 1:
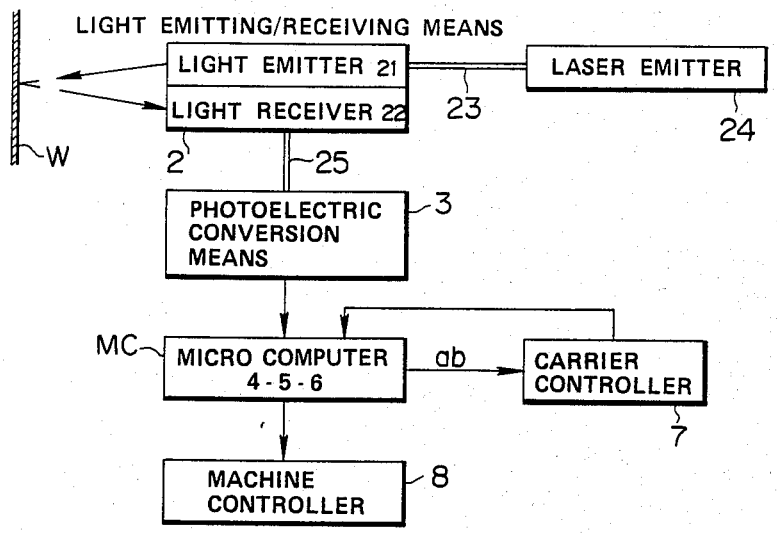
FIG. 1 is a block diagram of a first embodiment of the present invention using a microcomputer as a component thereof.

Referring to FIG. 1, the broken line up yarn detecting method of the present invention can employ a light emitter 21 which is adapted to travel widthwise across a row of yarns W comprising many warps Wl, W2 . . . Wn supplied in a line up condition. The light emitter 21 sequentially radiates a fine beam towards the yarns from one end Wl to the other Wn. The flickering in the reflected light caused by the presence or absence of yarns while the beam travels widthwise are transmitted to a photoelectric conversion means 3 and thereafter to a count means 4 where the number of flickerings are electrically counted to obtain a current value for the number of existing yarns. The current value is compared with a threshold value (corresponding to the desired number of yarns) by a comparator means which emits a signal (ab) indicating an abnormal condition if the current value differs from the threshold value.

Figure 3:
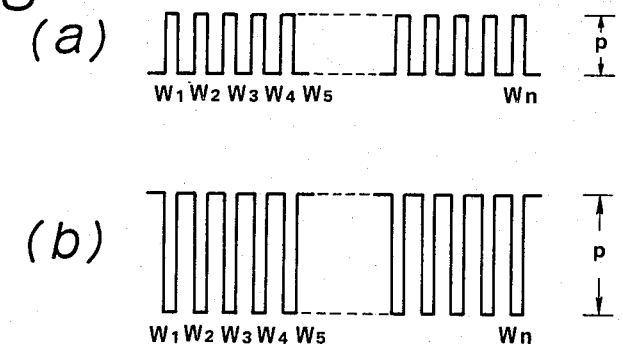
FIG. 3(*a*) is a waveform of a photoelectric conversion means.
Figure 4:
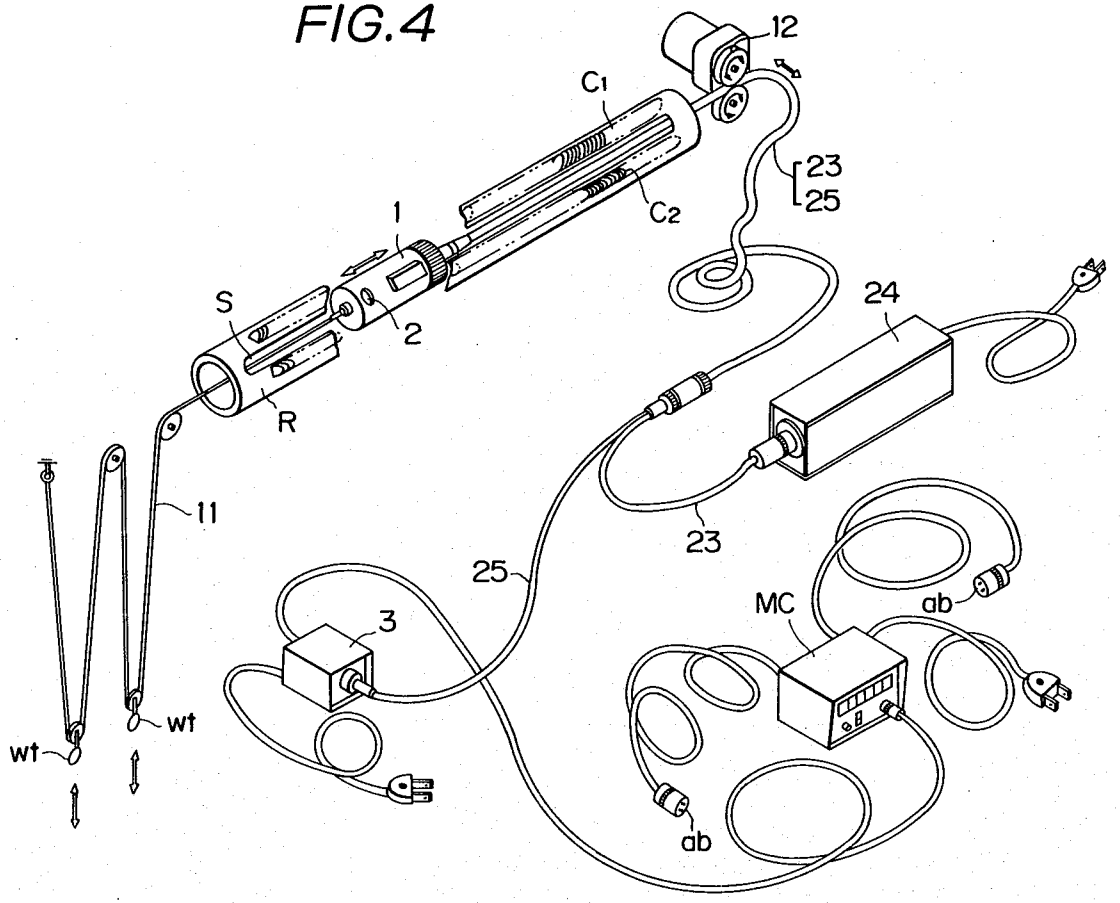
FIG. 4 is a perspective view of a system according to a first embodiment of the feeler of the present invention.

Referring to FIG. 4, a broken line up yarn detecting feeler according to the present invention comprises a carrier 1 adapted to shuttle along a rail R disposed widthwise across a row of yarns W consisting of many warps Wl, W2 . . . Wn supplied in a line up condition; a light emitting/receiving means 2 disposed in the carrier 1 and having a light emitter 21 (FIG. 1) and a light receiver 22 (FIG. 1). The light emitter 21 radiates a fine beam and the light receiver 22 receives flickering reflected light caused by the presence or absence of each yarn while the carrier 1 travels with the light emitter 21 radiating the beam toward the row of yarns; a photoelectric conversion means 3 for outputting pulse signals (p) (FIGS. 3*a*, 3*b*) corresponding to the number of flickerings, in response to an intermittent change in quantity of flickering light coming into the light receiver 22; a count means 4 (FIGS. 1 and 2) for counting the pulse signals (p) for each one stroke movement of the carrier 1 along the row of yarns W and for outputting the current value as the number of existing yarns; a threshold setting means 5 (FIGS. 1 and 2) for emitting a threshold signal by inputting a value corresponding to the number of warps Wl, W2 . . . Wn constituting the row of yarns W; and a comparator 6 for comparing the threshold signal from the threshold setting means 5 with the current value from the count means 4 and for outputting an alarm signal (ab) when these signals do not coincide with each other.

Figure 2:
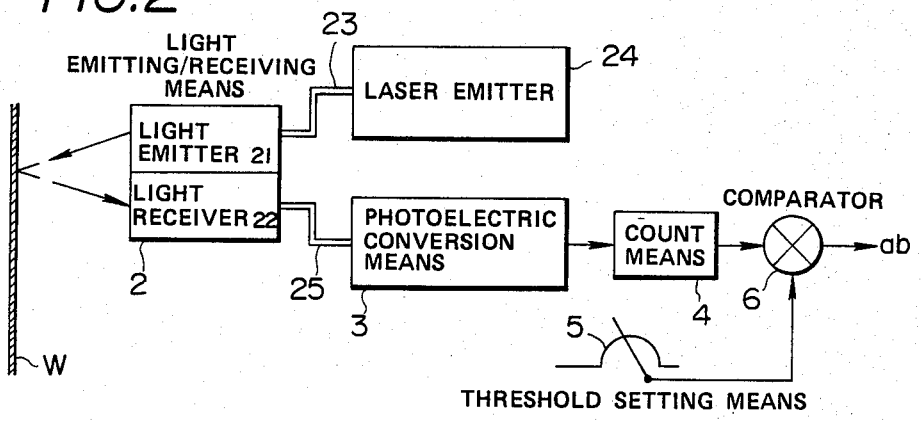
FIG. 2 is a block diagram of a second embodiment of the present invention.

Referring to FIGS. 1 and 2, a light emitting/receiving means 2 comprises a light emitter 21 and a light receiver 22. The means 2 is disposed in a carrier 1 and adapted to travel widthwise across a row of yarns W such as shown in FIGS. 4–10.

A laser emitter 24, for example a laser diode, can be used as a source of light for providing optical energy to the light emitter 21, to which a laser beam is transmitted via an optical fiber 23. A laser is not always necessary, instead, for example a beam emitted by a light emission diode (LED) can be used, in which case the light emitter 21 preferably uses a known spatial filter to prevent scattering and to radiate a fine beam.

Figures 5A, 5B:
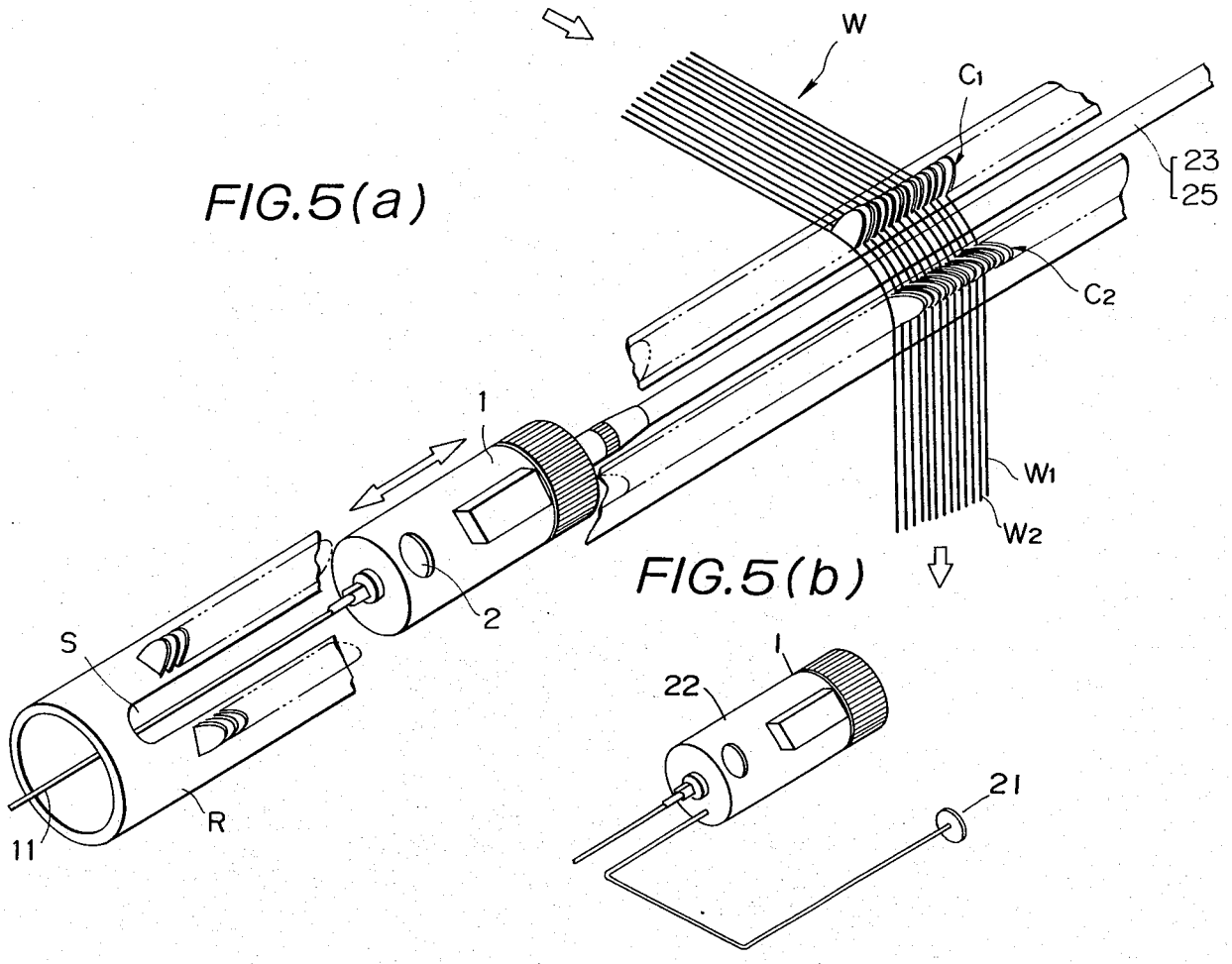
FIG. 5(*a*) is an enlarged view of a portion of the FIG. 4 system.

The light receiver 22 preferably uses a converging lens so that it can catch any flickering of the beam radiated to the row of yarns, W. In FIGS. 1 and 2, the light receiver 22 receives relected light, and in response to increases in the reflected light received by the recevier 22, a photoelectric conversion means 3 outputs pulse signals (p) as shown in FIG. 3(*a*). The present invention is not limited to this reflection type, but applicable to a direct light type wherein the light emitter and receiver 21 and 22 are disposed symmetrically with respect to a row of yarns W therebetween schematically such as shown in FIG. 5(*b*). In response to decreases in the quantity of light reflected by the warps Wl, W2 . . . Wn interrupting the beam from the emitter 21, the photoelectric conversion means 3 outputs pusle signals (p) as shown in FIG. 3(*b*).

Optical transmission from the light receiver 21 to the photoelectric conversion means 3 is performed via an optical fiber 25 (FIG. 4). The photoelectric conversion means 3 can use a photoelectric conversion element such as a PIN photodiode, an avalanche diode, a photocell or a phototransistor, but is not limited to such elements.

A known counter can be used as a count means 4 for counting the pulse signals (p) from the photoelectric conversion means 3, and a known register can be used as a threshold setting means 5 for storing the number of yarns W. A known comparator 6 can be used to compare the current value signal from the count means 4 with the threshold signal from the threshold setting means 5 and output an alarm signal (ab) if there is a difference therebetween. As will be evident to those skilled in the art, the means 4, 5 and 6 can be easily implemented using a microcomputer MC as shown in FIG. 1 if more reliability and miniaturization is desired.

The present invention is basically constructed as above, wherein a current value for the number of yarns in a row of line up yarns is counted and compared with a threshold; and if there is a difference an alarm signal (ab) is sent out to carrier controller 7 and a machine controller 8 in order to stop machine motion. The machine can also be stopped by turning off a main switch (not shown) of the machine.

In FIG. 4, the carrier 1 with the light emitting-/receiving means 2 is adapted to travel back and forth in a pipe-like rail R having rows of comb teeth Cl and C2 thereon. A slit S is formed in the rail R between the rows of teeth Cl and C2, to allow light to travel toward and away from the carrier 1. The carrier 1 of FIG. 4 is adapted to travel by the interaction of a tractive cord 11 having weights (wt) and a pullback feed roller 12. Reference numerals 23 and 25 identify optical fibers, reference numeral 24 identifies a laser emitter and reference numeral 3 identifies a photoelectric conversion means. As is well known to those skilled in the art, a microcomputer MC can be easily adapted to perform the functions of the count means 4, the threshold setting means 5 and the comparator 6.

Figure 7:
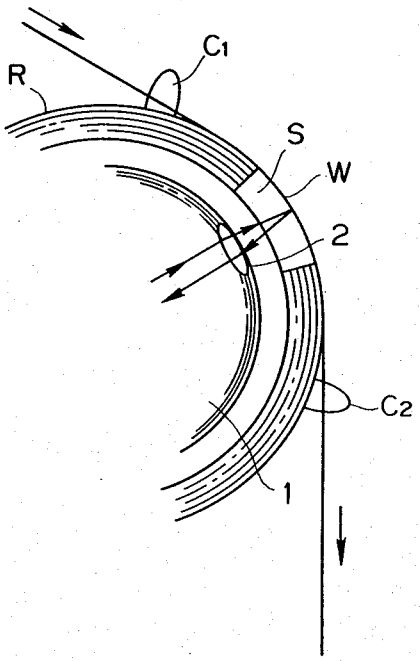
FIG. 7 is a detailed view of a portion of FIG. 6.
Figure 6:
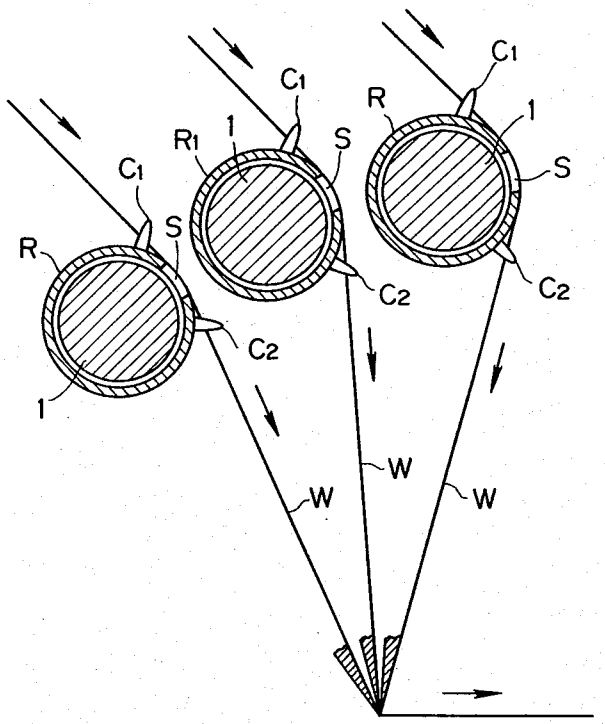
FIG. 6 is a sectional view showing a feeler according to the present invention applied to a warp knitting machine.
Figure 8:
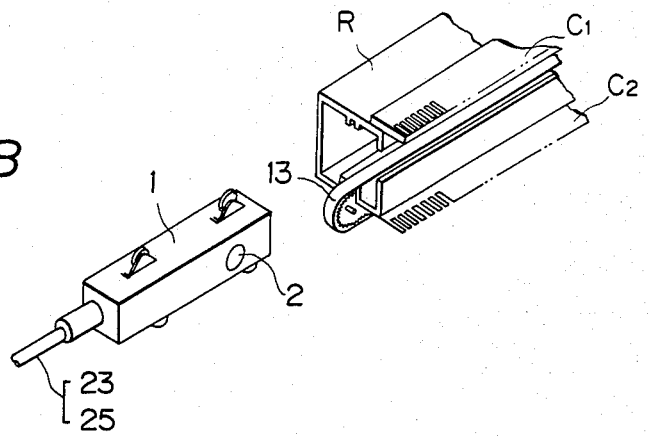
FIGS. 8 to 11 illustrate travel mechanisms of a carrier in a system according to the present invention.
Figure 9:
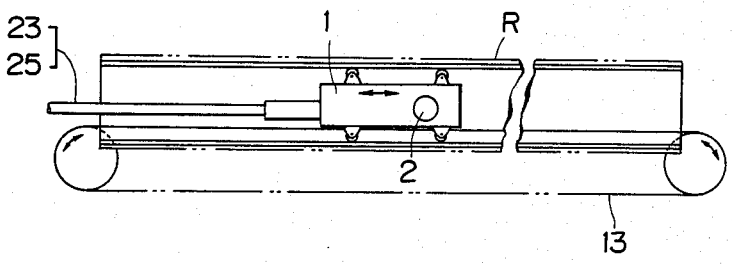
Figure 12:
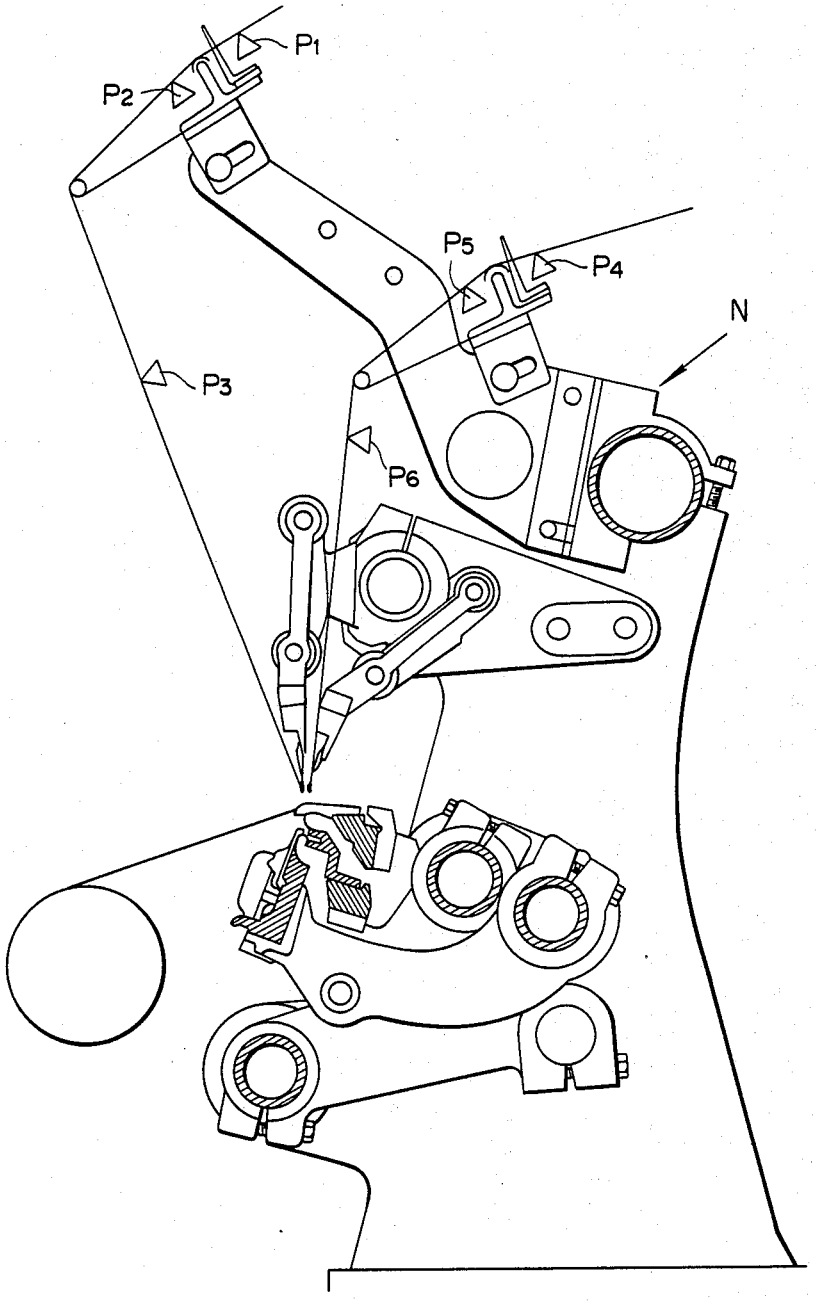
FIG. 12 illustrates an application of the present invention to a warp knitting machine.

FIG. 5(*a*) is an enlarged view of the carrier 1 and the rail R of FIG. 4. The row of yarns W is supplied in the direction indicated by the arrow A, keeping a line up condition by means of the rows of teeth Cl and C2 on the rail R. A feeler of this type is most suitable for a warp knitting machine where rows of yarns W are supplied in a superimposing condition as schematically shown in FIGS. 6 and 7. When applying this feeler to a warp knitting machine, the light emitting/receiving means 2 may be disposed at any of the positions Pl, P2, P3, P4, P5 and P6 of a machine N such as shown in FIG. 12.

Figure 10:
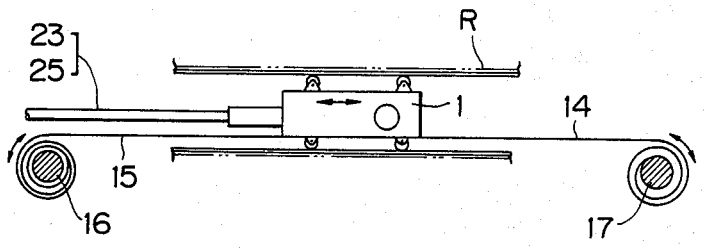
Figure 11:
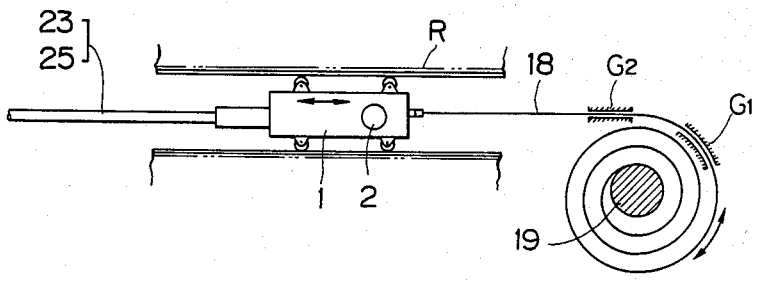

Other embodiments of the carrier 1 and the means 2 are shown in FIGS. 5(*b*) and 8–11. In FIG. 5(*b*) the carrier 1 is arranged so that light emitter 21 directly illuminates light receiver 22, and the light is interrupted by the intervening yarns. The positions of the light receiver 22 and light emitter 21 can be reversed from those shown in FIG. 5(*b*). The carrier 1 is adapted to travel by a reverse conveyer 13 in FIGS. 8 and 9. In FIG. 10, cords 14 and 15 are reciprocated by reels 16 and 17, thereby moving the carrier 1. In FIG. 11, a flexible band 18 restricted by guides Gl and G2 is reciprocated by a motor 19 whereby the carrier 1 travels back and forth past the row of line up yarns.

In a system embodying the method of the present invention light emitter 21 radiates a fine beam toward the yarns W and sequentially illuminates the yarns from one end Wl to the other Wn as shown in FIGS. 5(*a*) and 5(*b*). The yarns W are supplied in a line up condition in the direction of the arrow A.

If one of the yarns W breaks, no light is reflected to light receiver 22 by that yarn (FIG. 5(*a*)). The number of pulse signals output by the photoelectric conversion means 3 therefore decreases. Consequently, the current value counted by the count means 4 becomes smaller than the value set by the threshold setting means 5 and the comparator 6 outputs an alarm signal (ab).

If the light receiver 22 is arranged to receive direct light (FIG. 5(*b*)) and one of the yarns W breaks, the broken yarn does not interrupt the beam and the beam enters the photoelectric conversion means 3; thereby decreasing the output of pulse signals. Therefore the current value becomes smaller than the threshold and the comparator 6 outputs an alarm signal (ab) in the same manner as in above case.

It is very rare that the current value for the number of yarns becomes larger than the threshold. However one situation where this would occur is if one of the yarns W splits. In such a case the number of pulses would increase due to the split yarn, the comparator 6 would sense this condition and send out an alarm signal (ab).

The feeler in accordance with the present invention includes the carrier 1 with the light emitting/receiving means 2 adapted to shuttle along the rail R disposed widthwise across a row of yarns W as shown in FIG. 5. A fine beam is radiated towared the line up yarns to cause light to be reflected from or interrupted by the individual yarns. By adapting the travel speed of the carrier 1 to the rotional speed of the machine, and desired machanical follow-up is easily attainable. Furthermore, this feeler assures highly accurate performance because it monitors normal yarns whose optical properties are quite different from those of ravelling and other floating things and which normal yarns are stable in posture and position. This feeler minimizes any malfunctions, unlike other photoelectric feelers for monitoring an abnormal broken yarn.

As described above, the present invention can solve the problems of inefficient preparatory processes and mechanical follow-up such as exist in the dropper type detection feeler, and it can keep up with the technical progress of the recent high-speed textile machinery. Furthermore, the malfunction problem of other photoelectric detection feelers can be solved by monitoring normal yarns in accordance with the present invention. Thus, the present invention provides a highly reliable broken yarn detection technique. In this point, the present invention basically guarantees the progress of textile machinery toward high-speed and highly accurate operation.

Figure 13:
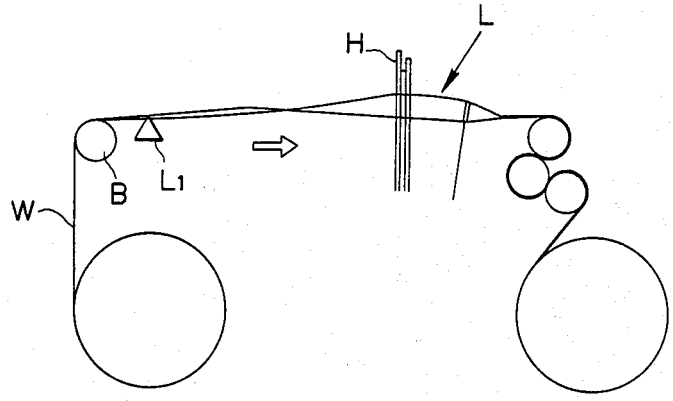
FIG. 13 illustrates an application of the present invention to a loom.
Figure 14:
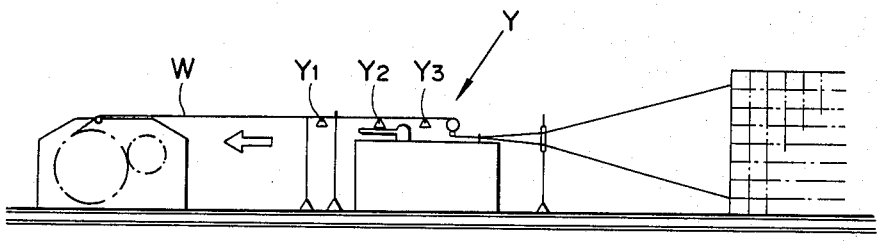
FIG. 14 illustrates an application of the present invention to a warping machine.

While preferred embodiments of the present invention are described above, it is to be understood that the invention is not limited thereto, but may be modified in various manners. For example, it is expected that the light emitting/receiving means 2 and the photoelectric conversion means 3 can easily be compactly and integrally incorporated into the carrier 1 using a subminiature laser diode as a light emitter and subminiature PIN photodiode as a light receiver. Furthermore the method and feeler of the present invention are intended for use in not only warp knitting machines N, but also in textile machines for weaving and processing line up yarns such as a loom L or a warping machine Y (FIGS. 13 and 14, respectively). In case of the loom L, the present invention is preferably applied to a position Ll which is between a breast beam B and a heald H and which is near the breast beam B where the warps make the least vertical movement. In case of the warping machine Y, a position Yl, Y2 or Y3 is preferable where the warps Y line up at the same level.

Those skilled in the art will recognize many modifications and equivalents of the present invention. The scope of the present invention is therefore limited only the appended claims and equivalents thereof.

What is claimed is:

1. A method of detecting a broken yarn in a row of line up yarns in a system having a movable detector, an input device and a comparator, said method comprising the steps of:

(a) moving the detector widthwise across the line up row of yarns;

(b) detecting the number of yarns in the line up row of yarns as the detector moves across the yarns;

(c) providing a threshold number of yarns;

(d) comparing the detected numbers of yarns and the threshold number of yarns; and (e) providing an alarm when the detected number of yarns differs from the threshold number of yarns.

2. A method of detecting a broken yarn in a system having a light emitter, a light receiver and a counter connected to the light receiver, according to claim 1, wherein (b) comprises the substeps of:

(i) illuminating the yarns in the row of line up yarns;

(ii) receiving light reflected from the yarns;

(iii) generating pulses in accordance with the received reflected light; and (iv) counting the number of generated pulses.

3. A method of detecting a broken yarn according to claim 2, wherein step (i) comprises sequentially illuminating yarns in the row of line up yarns, and step (e) comprises providing an alarm in response to the counter number of pulses differing from the threshold number of yarns.

4. An apparatus for detecting a broken yarn in a row of line up yarns, comprising:

detecting means for detecting the number of yarns in a line up row of yarns;

carrier means for carrying said detecting means widthwise across the line up row of yarns;

means for providing a threshold number of yarns; and comparator means for comparing the detected number of yarns and the threshold number of yarns and for providing an alarm when these numbers differ.

5. An apparatus for detecting a broken yarn according to claim 4, wherein the detecting means comprises:

light emitter means, connected to the carrier means, for emitting a beam of light so as to illuminate respective ones of the yarns in the row of line up yarns;

light receiver means, connected to the carrier means, for receiving light reflected from the respective ones of the yarns; and counter means, operatively connected to the light receiver means, for generating a count in accordance with the received reflected light.

6. An apparatus for detecting a broken yarn according to claim 5, wherein the detecting means further comprises conversion means, operatively connected between the light receiver means and the counter means, for providing pulses in response to the received reflected light, and wherein the counter means generate a count in accordance with the pulses from the conversion means.

7. An apparatus for detecting a broken yarn according to claim 6, wherein the carrier means includes means for periodically moving the carrier means at a substantially constant speed past the row of line up yarns, and wherein the comparator means compares the count generated by the counter means and the threshold number of yarns for each pass of the carrier means past the row of line up yarns.

8. An apparatus for detecting a broken yarn according to claim 7, further comprising:

means for holding the respective yarns of the line up yarns at a substantially constant spacing from each other in a region illuminated by the light emitter means.

9. An apparatus for detecting a broken yarn according to claim 8, wherein the light emitter means comprises a laser, and the conversion means comprises a photoelectric conversion circuit.

10. An apparatus for detecting a broken yarn according to claim 4, wherein the detecting means comprises:

light emitter means, arranged to move in response to movement of the carrier, for emitting a beam of light so as to illuminate respective ones of the yarns in the row of line up yarns;

light receiver means, arranged to move in accordance with movement of the carrier and such that the row of line up yarns is interposed between the light emitter means and the light receiver means, for receiving light emitted from the light emitter means; and counter means, operatively connected to the light receiver means, for generating a count in accordance with the received light.

11. An apparatus for detecting a broken yarn according to claim 10, wherein the detecting means further comprises conversion means, operatively connected to the light receiver means, for providing pulses in response to the received light, and wherein the counter means generates a count in accordance with the pulses provided by the conversion means.

12. An apparatus for detecting a broken yarn according to claim 11, wherein the carrier means includes means for periodically moving the carrier means at a substantially constant speed past the row of line up yarns, and wherein the comparator means compares the count generated by the counter means and the threshold number of yarns for each pass of the carrier means past the row of line up yarns.

13. An apparatus for detecting a broken yarn according to claim 12, wherein the conversion means comprises a photoelectric receiver.

14. An apparatus for detecting a broken yarn according to claim 12, wherein the light emitter means comprises a laser.

15. A method of detecting a broken yarn in a row of line up yarns in a system having a light emitter, a light receiver opposite the row of line up yarns from the light emitter and a counter connected to the light receiver, an input device and a comparator, said metod comprising the steps of:

(a) detecting the number of yarns in a line up row of yarns;

(b) providing a threshold number of yarns;

(c) comparing the detected number of yarns and the threshold number of yarns; and (d) providing an alarm when the detected number of yarns differs from the threshold number of yarns.

16. A method of detecting a broken yarn according to claim 15, wherein step (a) further comprises the substeps of:

(i) illuminating the yarns in the row of line up yarns;

(ii) receiving light and light interruptions directly through the yarns;

(iii) generating pulses in accordance with the interruptions; and (iv) counting the number of generated pulses.

17. A method of detecting a broken yarn according to claim 16, wherein step (i) further comprises sequentially illuminating yarns in the row of line up yarns; and step (d) further comprises providing an alarm when counted number of pulses differs from the threshold number of yarns.

* * * * *

UNITED STATES PATENT AND TRADEMARK OFFICE

CERTIFICATE OF CORRECTION

PATENT NO. : 4,772,800

DATED : September 20, 1988

INVENTOR(S) : Kenzo Kanai et al.

It is certified that error appears in the above-identified patent and that said Letters Patent is hereby corrected as shown below:

Column 3, line 44, "yarns, W." should be --yarns W.--;

Column 6, line 30, "counter" should be --counted--.

Signed and Sealed this

Tenth Day of January, 1989

*Attest:*

DONALD J. QUIGG

*Attesting Officer*

*Commissioner of Patents and Trademarks*